United States Patent [19]

Yoshizaki

[11] Patent Number: 4,489,312

[45] Date of Patent: Dec. 18, 1984

[54] SELECTIVE TEST CIRCUIT FOR FIRE DETECTORS

[75] Inventor: Yukio Yoshizaki, Tokyo, Japan

[73] Assignee: Nittan Company, Limited, Tokyo, Japan

[21] Appl. No.: 368,224

[22] Filed: Apr. 14, 1982

[30] Foreign Application Priority Data

Apr. 15, 1981 [JP] Japan ..... 56-55534

[51] Int. Cl.[3] ..... G08B 29/00

[52] U.S. Cl. ..... 340/514; 340/518; 324/158 F

[58] Field of Search ..... 340/514–516, 340/518, 500, 501, 506–509, 588, 589, 825.54, 825.06–825.12; 169/23; 324/158 F, 158 R

[56] References Cited

U.S. PATENT DOCUMENTS

| | | | |
|---|---|---|---|
| 3,566,399 | 2/1971 | Weld | 340/514 |
| 3,717,862 | 2/1973 | Sasaki | 340/514 |
| 3,848,241 | 11/1974 | LeNay et al. | 340/514 |
| 4,224,466 | 9/1980 | Bush et al. | 340/514 |

*Primary Examiner*—Donnie L. Crosland

*Attorney, Agent, or Firm*—Abelman Frayne Rezac & Schwab

[57] ABSTRACT

A circuit for selectively or extractively testing a fire detector among a plurality of fire detectors which are connected between an alarming line extending from the section relay of a receiving unit and a common line is disclosed. An inherent address code is allotted to each fire detector. When an address signal transmitted through the alarming line coincides with the allotted inherent address code, a coincidence signal is produced and in response to said coincidence signal a test voltage is generated for each fire detector.

4 Claims, 6 Drawing Figures

| Fig.4A | Fig.4B |
|---|---|

SELECTIVE TEST CIRCUIT FOR FIRE DETECTORS

TECHNICAL FIELD OF THE INVENTION

This invention relates to an operation test circuit for fire detectors. More particularly, it relates to a circuit for selectively testing any fire detector among a plurality of fire detectors which are connected to an alarming line extending from the receiving unit at the control center and a common line.

BACKGROUND OF THE INVENTION

Today in buildings or any other constructions, the fire detecting system in which a number of fire detectors are distributed in a plurality of sections, a plurality of detectors in one section are connected to one alarming line for each section, and a plurality of alarming lines are connected to a receiving unit.

Conventionally, in order to test fire detectors in such a system, the inspector goes over to each place where a fire detector is installed, and confirm the operability of each fire detector by raising its temperature using, for instance, a cigarette lighter, or by generating smoke artificially. The test method in which an electrical change to actuate a fire detector is applied to the fire detector to be tested is also known. Even by this method, the inspector must go over to the place where the detector in question is installed. The electrical change can be supplied from the receiving unit side. But a plurality of fire detectors are connected to one alarming line, and therefore, the inspector cannot identify which detector has been actuated from the receiving unit side, and he cannot select and test a particular detector, either.

In the copending Patent Application Ser. No. 351,916, a selectively testable fire detector, which generates a signal voltage when said detector has counted the designated number of pulses sent forth from the receiving unit by way of the alarming line, is proposed. However, the fire detector of said application can only be designated by incremental numbers from the first one in an order but an arbitrarily selected one cannot be tested.

The purpose of this invention is to provide a selective test circuit for fire detectors in which the disadvantage in the prior art fire detector test circuits as mentioned above is eliminated and every fire detector can be selectively tested from the side of the receiving unit.

DISCLOSURE OF THE INVENTION

According to this invention in a broader sense, there is provided a circuit for selectively testing detectors connected between one of a plurality of alarming lines each extending from a section relay of a receiving unit and a common line comprising: an address-signal-sensing circuit for producing a coincidence signal when coincidence is sensed between an address signal transmitted through the alarming line and the inherent address code allotted to each fire detector beforehand; a test-voltage-generating circuit for generating a test voltage to be applied to each fire detector in response to said coincidence signal; a serial connection of a first Zenner diode and a condenser connected between the alarming line and the common line; and means for generating a resetting signal to reset the address-signal-sensing circuit and the test-voltage-generating circuit when the alarming line voltage is in excess of a predetermined value; whereby the condenser is charged at a voltage exceeding a predetermined value and, at the same time, resets the address-signal-sensing circuit and the test-voltage-generating circuit; and the voltage charged on the condenser acts as the power source for actuating the address-signal-sensing circuit and the test-voltage-generating circuit.

In a more particular sense, there is provided a circuit for selectively testing fire detectors as recited in claim 1, wherein the means for generating the resetting signal is comprised of a third Zenner diode.

Further, a selective test circuit which is further provided with a means for producing a finish signal when the address signal has been sent out, a non-operation sensing circuit for producing a detector-non-operation signal, a device for displaying the address code sent forth, etc., is provided.

Now the invention is described in detail with reference to the attached drawings.

BRIEF DESCRIPTION OF THE ATTACHED DRAWINGS

DETAILED DESCRIPTION OF EMBODIMENTS OF THE INVENTION

Figure 1:
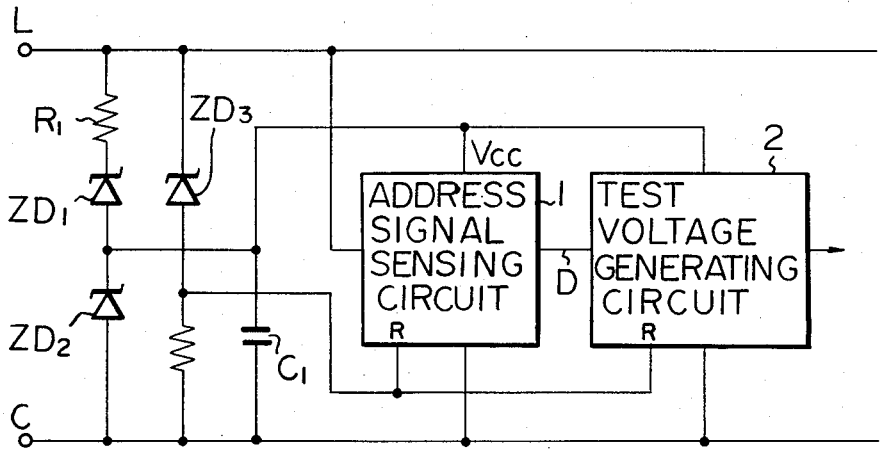
FIG. 1 is a circuit diagram representing the construction of the fire detector side in an embodiment of this invention partially including representation in blocks.

FIG.1 is a circuit diagram representing the construction of the fire detector side in an embodiment of this invention, which partially includes the presentation in blocks. A serially connected circuit comprising a resistor $R_1$, a first Zenner diode $ZD_1$ and a condenser $C_1$ is connected between an alarming line L and a common line C. The first Zenner diode $ZD_1$ does not conduct by an ordinary alarming line voltage $E_1$ (20 V, for instance) but conducts by a higher voltage $E_2$ (30 V, for instance). The voltage which is charged on the condenser $C_1$ acts as the power source for actuating an address signal sensing circuit 1 and a test-voltage-generating circuit 2. A second Zenner diode $ZD_2$ is connected across the condenser $C_1$. The condenser $C_1$ can be charged up to the Zenner voltage of said Zenner diode $ZD_2$. A third Zenner diode $ZD_3$ is connected between the alarming line L and the common line C in series with a resistor and it will conduct by said predetermined voltage $E_2$ to reset the address signal sensing circuit 1 and the test-voltage-generating circuit 2. In other words, the third Zenner diode $ZD_3$ operates as the means for generating a resetting signal.

The operation of the circuit shown in FIG. 1 is as follows.

The address signal sensing circuit 1 senses the address signal (address code) which is transmitted by the signal pulses which are superposed on the alarming line voltage $E_1$, and produces a coincidence signal, which is supplied to the test-voltage-generating circuit 2 when the transmitted address signal coincides with the inherent address code which has been allotted to each of the fire detectors. The test-voltage-generating circuit 2 generates a test voltage and supplies it to the electrode of an ionizing smoke detector, for instance, to simulatedly cause a change due to smoke in the voltage generated by the detector. The caused voltage change triggers a thyristor in the fire detector, which makes the fire detector operate. Thus the receiving unit learns that the detector in question has operated. The electical charge on the condenser $C_1$ is discharged through the first Zenner diode $ZD_1$ and the thyristor when said thyristor conducts.

Figure 2:
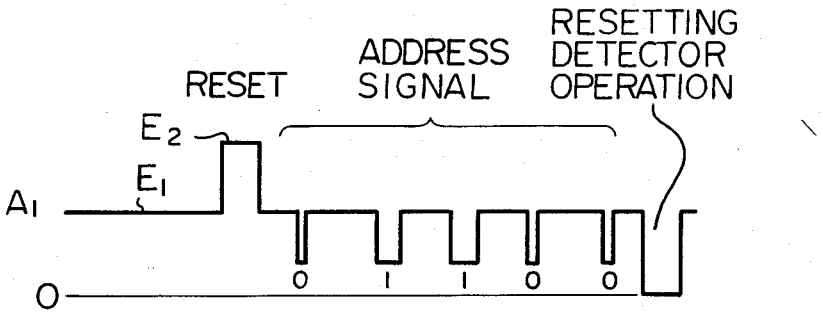
FIG. 2 is a time chart showing an example of an address signal (address code representing a fire detector) to be used in the embodiment shown in FIG. 1.

When the fire detectors are tested, the predetermined voltage $E_2$ is sent forth first of all. Thereafter, the address signal which is produced, for instance, by superposing negative pulses of wide and narrow widths on the ordinary alarming line voltage $E_1$ is transmitted as shown in FIG. 2. In the example shown in FIG. 2, the address signal comprises an address code "0 1 1 0 0".

Figure 3:
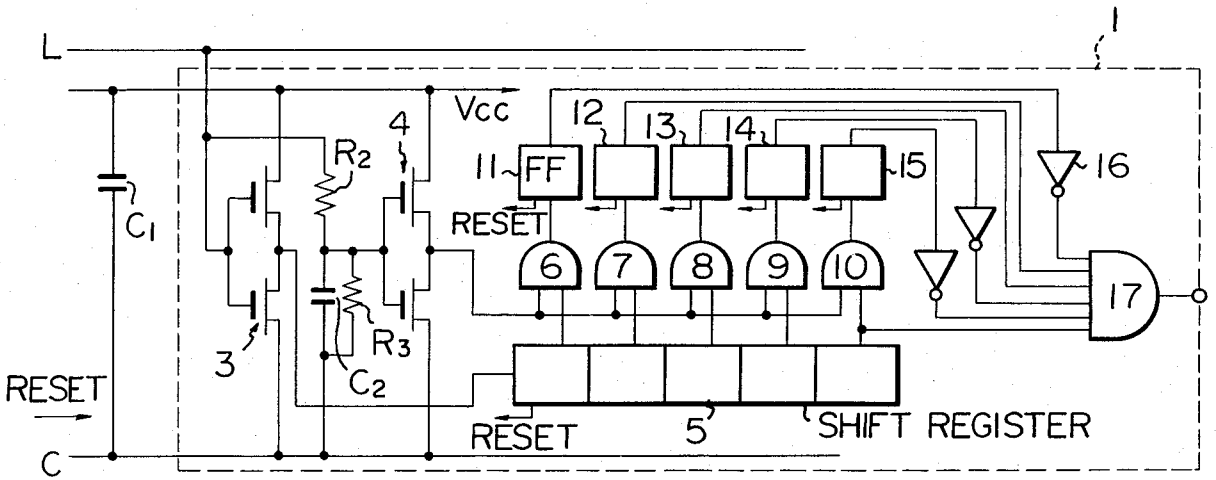
FIG. 3 is an example of the address signal sensing circuit to be used in the embodiment shown in FIG. 1 partially including representation in blocks.

An example of the construction of the address signal sensing circuit 1 is shown in FIG. 3. A gate of a complementary metal oxide semiconductor CMOS 3, which is actuated by the voltage charged on the condenser $C_1$, is connected to the alarming line L and the output terminal of the CMOS 3 is connected to the input terminal of a shift register 5 so that the output of the CMOS 3 is supplied to the shift register 5. The shift register 5 is constructed so that the input terminals thereof receive the negative pulses from the alarming line L, shifting from the first one to the next pulse by pulse, and the output terminals thereof transmit the corresponding negative pulse one by one. A serial connection of a resistor $R_2$ and a resistor $R_3$ is inserted between the alarming line L and the common line C, and a condenser $C_2$ is connected across the resistor $R_3$ in parallel, and the connection point of the resistor $R_2$ and the resistor $R_3$ is connected to the gate of another CMOS 4. The output of the CMOS 4 is on the high level only when the width of the pulse transmitted from the alarming line L is relatively wide and said output is on the low level when the width of the pulse is relatively narrow. That is, the negative pulse with a narrow width cannot lower the voltage charged on the condenser $C_2$ so that the CMOS 4 is not triggered, and only the negative pulse with a wide width can lower the voltage so that the CMOS 4 is triggered. The output of the CMOS 4 is input to one of the input terminals of each of AND gates 6 to 10. The other input terminal of each of the AND gates 6 to 10 is connected to the output terminal of each step of the shift register 5, respectively. The putput terminal of each of the AND gates 6 to 10 is respectively connected to the setting terminal of each of flip-flop circuits 11 to 15 and the output terminal of each of the flip-flop circuits 11 to 15 is connected to an AND gate 17 directly or through a NOT circuit 16. A coincidence signal is produced in the output terminal of the AND circuit 17 if the combination of the outputs of the flip-flop circuits 12–15 accompanied by the NOT circuit 16 and those not accompanied by the NOT circuit coincides with the address code allotted to the fire detector in question. In FIG. 3, is shown a connection which corresponds to the address code "0 1 1 0 0". Incidentally, all the resetting terminals of the flip-flop circuits 11 to 15 and the shift register 5 are connected to the resetting signal generating means.

The operation of the selective test circuit constructed as explained above is as follows.

The condenser $C_1$ is charged by the predetermined voltage $E_2$ transmitted on the alarming line L and the negative pulses, which are transmitted to the alarming line superposed on the ordinary alarming line voltage $E_1$, are sensed by the address signal sensing circuit 1. When the thus sensed set of negative pulses coincide with an inherent address code which is allotted, a coincidence signal is applied to the test voltage generating circuit 2, and thus the circuit is actuated to apply a test voltage to a fire detector. Thus, any individual fire detector can be tested by designating it by means of its address code.

Figures 4, 4A:
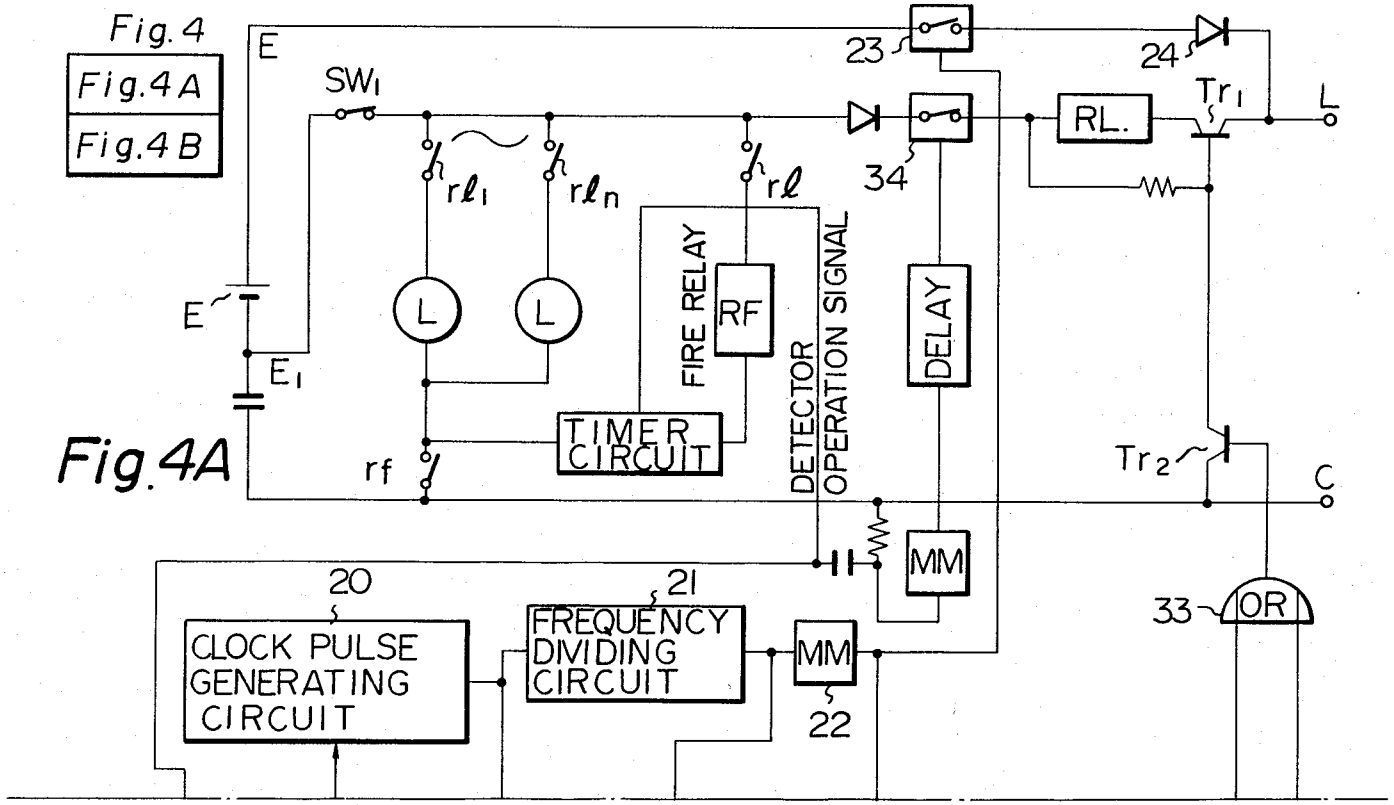
FIG. 4 is a block diagram of an example of the construction of the receiving unit side corresponding to the above-mentioned embodiment.
Figure 4B:
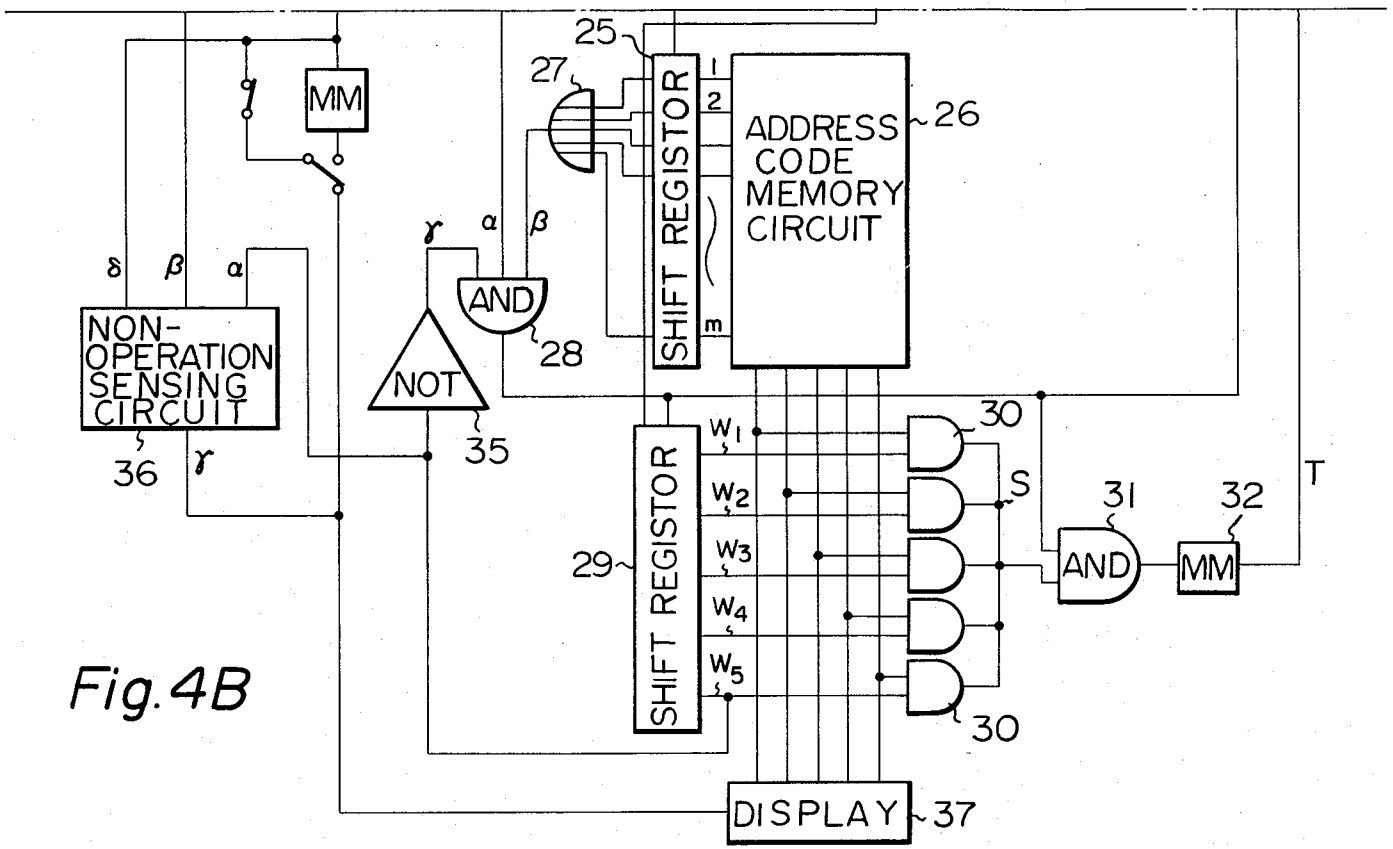

FIG. 4 represents an example of the receiving unit side circuit of the test circuit of the invention for testing a number of fire detectors successively and automatically. The output terminal of a clock pulse generating circuit 20 is connected to the input terminal of a frequency dividing circuit 21 and the first input terminal $\alpha$ of an AND gate 28. The output terminal of the frequency dividing circuit 21 is connected to the input terminal of a monstable multivibrator MM 22 and the first input terminal of a shift register 25. There are as many steps as the number (m) of fire detectors in the shift register 25. The output terminal of the MM 22 is connected to the trigger terminal of a switching circuit 23 and the first input terminal (resetting terminal) of a shift register 29.

The first output terminal, the second output terminal and so on of the shift register 25 are respectively connected to the first input terminal, the second input terminal and so on of an address code memory circuit 26 and the first input terminal, the second input terminal and so on of an OR circuit 27, the output terminal of said OR circuit 27 being connected to the second input terminal $\beta$ of the AND gate 28. The output terminal of the AND gate 28 is connected to the second input terminal of the shift register 29, one input terminal of an AND circuit 31 and one input terminal of an OR circuit 33.

The first output terminal, the second output terminal and so on of the address code memory circuit 26 are respectively connected to the first input terminal of a first AND gate 30, the first input terminal of a second AND gate 30 and so on. The first output terminal $W_1$, the second output terminal $W_2$ and so on of the shift register 29 respectively are connected to the second input terminal of the first AND gate 30, the second input terminal of the second AND gate 30 and so on. There are as many terminals as the number of the digits of the address code, that is, five terminals in this case. All the output terminals S of all the AND gates 30 are connected to the second input terminal of the AND circuit 31 and the output terminal of the AND circuit 31 is connected to the input terminal of a monostable multivibrator MM 32, the output terminal T of said MM 32 being connected to the second input terminal of the OR circuit 33. The output terminal of the OR circuit 33 is connected to the base of a transistor $Tr_2$.

One terminal of an electric source E is connected to one terminal of a switching circuit 34 through a source switch $SW_1$ and a diode, and the other terminal of the switching circuit 34 is connected to the alarming line L through one section relay $RL_1$ of a group of section relays $RL_1 \sim RL_n$ and one transistor $Tr_1$, the base of which is connected to the collector of the transistor $Tr_2$. (There are as many section relays as the number (n) of sections, but only $RL_1$ is shown in FIG. 4). The other terminal of the electric source E is also connected to the alarming line L through the switching circuit 23 and a diode 24. A combination of a fire relay and a timer circuit for producing a detector-operation signal is connected between the alarming line L and the common line C through a contact rl, and a lamp or an equivalent indicator is respectively connected in parallel with said combination through a contact $rl_1$, . . . or $rl_n$ corresponding to each section. The contact rl closes when any of section relays $RL_1 \sim RL_n$ operates.

The output terminal of said combination is connected to an input terminal $\beta$ of a detector-non-operation sensing circuit 36 and the trigger terminal of the switching circuit 34 through a serial connection of a monostable multivibrator and a delay circuit. To another input terminal $\alpha$ of the detector-non-opertion sensing circuit 36 is connected the output terminal $W_5$ (the last terminal) of the shift register 29, and the output terminal $W_5$ is also connected to a third input terminal $\gamma$ of the AND gate 28 through a NOT circuit 35. An output terminal $\gamma$ of the detector-non-operation sensing circuit 36 is connected to an input terminal of a display device 37 and to an input terminal of the clock pulse generating circuit 20 through a combination of switches and a monostable multivibrator. The display device 37 is provided with input terminals which are connected to the output terminals of the address code memory circuit 26. Another output terminal $\delta$ of the detector-non-operation sensing circuit 36 is connected to the input terminal of the clock pulse generator 20 through said combination of switches and the monostable multivibrator.

The operation of the circuit shown in FIG. 4 is as follows.

The frequency dividing circuit 21 produces a pulse for every predetermined number of pulses generated by the clock pulse generating circuit 20. The output pulses of the frequency dividing circuit are fed to the MM 22 to produce pulses with a prescribed time duration. The pulses with the prescribed time duration fed to the trigger terminal of the switching circuit 23 to close the switching circuit for the prescribed time duration and to send forth the predetermined voltage $E_2$ from the electric source E to the alarming line L through the diode 24.

An output pulse of the frequency dividing circuit 21 applied to the shift register 25 produces a high level state at the first output terminal of the shift register 25 to be applied to the first input terminal of the address code memory circuit 26 so that the address code memory outputs the address code allotted to a specified detector (the first detector, for instance), such as a logic state of "0 1 1 0 0". The high level state at the first output terminal of the shift register 25 is also applied to the AND gate 28 through the OR circuit 27 to open the AND gate 28. Accordingly, the clock pulses are applied to the shift register 29 through the AND gate 28. When the output of the MM 22 become off, the clock pulses applied to the shift register 29 through the AND gate 28 successively turn high the level of the output terminals $W_1$ to $W_5$ of the shift register 29. Thus the outputs of the AND gates 30 forms a logic state "0 1 1 0 0", for instance, by successive pulses from the clock pulse generator 20 according to the address code stored in the address code memory circuit. The outputs of the AND gates 30 and the clock pulses supplied through the AND gate 28 are applied to MM 32 through the AND circuit 31 to produce a pulse with a fixed pulse width every time a clock pulse comes. That is, pulses of a wide width and a narrow width are produced in response to the state "1" and "0" of the address code. The output of MM 32 and the clock pulses coming from the AND gate 28 are applied to the base of the transistor $Tr_2$ through the OR circuit 33. That is, the transistor $Tr_2$ becomes on by the pulses of a wide or a narrow width which is determined according to the address code at every clock pulse.

In the duration during which the transistor $Tr_2$ is in the "on" state, the transistor $Tr_1$ is in the "off" state to interrupt the current to be sent forth from the electric source E to the alarming line L through the section relay $RL_1$. More particularly, the ordinary alarming line voltage $E_1$ intermittently drops according to the pulses with long and short duration determined by the address code. Thus a specified combination of negative pulses of the broad width and narrow width determined by the address code is sent forth. When the address signal ("0 1 1 0 0") is sent forth and the specified (first) detector is actuated and tested, the section relay $RL_1$ is actuated to close the contact rl and $rl_1$. And the detector-operation signal is produced, whereupon a lamp or an equivalent indicator confirms the detector-operation. The switching circuit 34 is monentarily opened to restore the detector after some fixed time delay.

The output from the output terminal $W_5$ of the shift register 29 is applied to the third input terminal $\gamma$ of the AND gate 28 through the NOT circuit 35 to close the AND gate 28 and, therefore, clock pulses from the clock pulse generating circuit 20 can no longer be applied to the shift register 29 through the AND gate 28.

A second output pulse of the frequency dividing circuit 21 is applied to the shift register 25 to produce the high level state at a second output terminal of the shift register 25. When the output from the MM 22 is applied to the shift register 29 to reset it, the AND gate 28 then opens and another detector can be tested in the same manner as explained in the above.

The output from the output terminal $W_5$ of the shift register 29 is also applied to the input terminal $\alpha$ of the detector-non-operation sensing circuit 36 to send forth a finish signal when the transmission of the address signal is finished. The detector-non-operation sensing circuit 36 produces a detector-non-operation signal at the output terminal $\gamma$ unless a detector-operation signal is applied to the input terminal $\beta$ within a fixed time, since the finish signal is applied to the input terminal $\alpha$. The detector-non-operation signal is transmitted to the display device 37 to indicate the address code of the detector concerned, as the address code of the detector under testing is previously applied to the display device 37 from the address code memory circuit 26.

Figure 5:
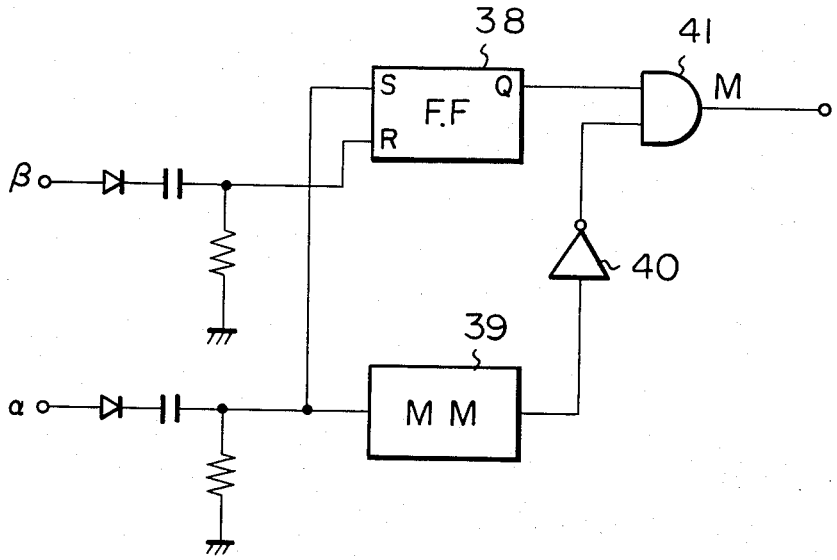
FIG. 5 is an example of the non-operation sensing circuit to be used in the embodiment shown in FIG. 4 partially including representation in blocks.

An example of the detector non-operation sensing circuit 36 is constructed as shown in FIG. 5. The input terminal $\alpha$ is connected to the setting terminal S of a flip-flop circuit FF 38 and the input terminal of a monostable multivibrator MM 39 through a differentiating circuit. The input terminal $\beta$ is connected to the resetting terminal of the FF 38 through a differentiating circuit. The output terminal of the FF 38 is connected to the first input terminal of an AND gate 41 and the output terminal of the MM 39 is connected to the second input terminal of said AND gate 41 through a NOT circuit 40. The output terminal M of the AND gate 41 is connected to the input terminal of the display device 37.

The operation of the circuit shown in FIG. 5 is as follows.

The input signal at the input terminal $\alpha$ is applied to the setting terminal S after being differentiated to set the FF 38 and is also applied to the MM 39 to trigger it. The MM 39 produces an output pulse of a fixed width and the output pulse is applied to the AND gate 41 through the NOT circuit 40 to close the AND gate 41. The output pulse from the MM 39 becomes off after a fixed time duration and then the AND gate 41 opens to pass the output signal from the FF 38 to make a non-operation signal. If a detector actuating signal is applied to the input terminal $\beta$ within the fixed time duration, the FF 38 is reset and the detector-non-operation signal is not produced.

The above is a practical embodiment of this invention. According to this invention, however, one of a plurality of fire detectors connected to an alarming line can be selectively tested in accordance with an embodiment as follows, for instance.

In place of the register 25 in FIG. 4, a decoder is provided so that said decoder can produce the high level state at any of the input terminals of the address code memory circuit 26 by operation of a manual operation board. Thus an arbitrarily selected fire detector can be tested from the control center. This is the important aspect of this invention.

It should be understood that the construction of this invention is not limited to the examples stated above and some part of the construction exemplified in the above may be omitted or may be replaced by manual operation. The mode of the address signal is not limited to the above-mentioned system. For example, it is all right, if a means for generating timing pulses is provided in the address signal sensing circuit and a pulse is produced from a receiving unit only for a digit of the address code corresponding to "1", and no pulse is produced for a digit of the address code corresponding to "0". Alternatively, the timing pulses may be applied from the side of the receiving unit and another pulse may be supplied after a timing pulse in order to express the state "1".

INDUSTRIAL APPLICABILITY

As stated in the above, an inherent address code is allotted to each detector and the detector which is designated by the address signal can be tested and, therefore, each detector or any specified detector can be tested manually or automatically from the place where the receiving unit is installed. Thus, the fire detectors and the like can easily be administered and the reliability thereof is improved. It is not necessary to increase the number of lines connecting the fire detectors and the receiving unit. No additional electric current is required for monitoring and there is no misoperation is apprehended since no current flows in the address-signal-sensing circuit and the test voltage generating circuit under an ordinary monitoring condition.

I claim:

1. A circuit for selectively testing detectors connected between one of a plurality of alarming lines each extending from a section relay of a receiving unit and a common line comprising: an address-signal-sensing circuit for producing a coincidence signal when coincidence is sensed between an address signal transmitted through the alarming line and the inherent address code allotted to each fire detector beforehand; a test-voltage-generating circuit for generating a test voltage to be applied to each fire detector in response to said coincidence signal; a serial connection of a first Zenner diode and a condenser connected between the alarming line and the common line; and means for generating a resetting signal to reset the address-signal-sensing circuit and the test-voltage-generating circuit when the alarming line voltage is in excess of a predetermined value; whereby the condenser is charged at a voltage exceeding a predetermined value and, at the same time, resets the address-signal-sensing circuit and the test-voltage-generating circuit; and the voltage charged on the condenser acts as the power source for actuating the address-signal-sensing circuit and the test-voltage-generating circuit.

2. A circuit for selectively testing fire detectors as recited in claim 1, wherein the means for generating the resetting signal is comprised of a third Zenner diode.

3. A circuit for selectively testing fire detectors as recited in claim 1 or claim 2, which is further provided with means for producing detector-operation signal upon actuation of one of the section relays of the receiving unit; means for producing a finish signal when transmission of the address signal finishes; and a non-operation sensing circuit for producing a detector non-operation signal after receiving the finish signal and the detector-operation signal provided that no detector-operation signal is further received after transmission of the address signal has finished.

4. A circuit for selectively testing fire detectors as recited in claim 3, wherein a display device is provided for indicating the address code selectively sent forth in accordance with the detector non-operation sensing signal.

* * * * *